US005290064A

United States Patent [19]

Leon et al.

[11] Patent Number: 5,290,064

[45] Date of Patent: Mar. 1, 1994

[54] COMBINATION BAIL AND TIP FOR A SKI POLE

[76] Inventors: Raul Leon, 1500 Country Vistas La., Bonita, Calif. 91902; Timothy J. Miranda, 49 E. Flower St. #259, Chula Vista, Calif. 91910

[21] Appl. No.: 44,770

[22] Filed: Apr. 12, 1993

[51] Int. Cl.[5] ..... A63C 11/24

[52] U.S. Cl. ..... 280/824

[58] Field of Search ..... 280/819, 823, 824

[56] References Cited

U.S. PATENT DOCUMENTS

| | | | |
|---|---|---|---|
| 3,963,254 | 6/1976 | Aho | 280/824 |
| 4,582,341 | 4/1986 | Erickson | 280/824 |
| 4,676,525 | 6/1987 | Sorlien et al. | 280/824 |
| 4,787,652 | 11/1988 | Pronzati | 280/824 |
| 4,921,275 | 5/1990 | Santanen et al. | 280/824 |
| 4,955,969 | 9/1990 | Jansson et al. | 280/824 |

FOREIGN PATENT DOCUMENTS

| | | | |
|---|---|---|---|
| 2748491 | 5/1978 | Fed. Rep. of Germany | 280/824 |
| 2514652 | 4/1983 | France | 280/824 |
| 2580511 | 10/1986 | France | 280/824 |

*Primary Examiner*—Brian L. Johnson

*Attorney, Agent, or Firm*—Frank D. Gilliam

[57] ABSTRACT

A combination bail and tip for a pole used in snow skiing. The combination bale and tip is formed from a rigid material such as metal or plastic. The combination bale and tip is rectilinear on its outer surface and curvilinear on its inner surface. The outer surface is substantially in the form of a right angle with one surface being parallel with the longitudinal center line and the outer surface being normal to the longitudinal center line of the pole. The lower end of the parallel portion of the bale or tip is in the form of substantially a right triangle wedge with the inner surface angled from the rectilinear surface toward the curvilinear surface. An opening is formed in the top surface to receive the distal end of a ski pole which is fixedly attached therein.

12 Claims, 1 Drawing Sheet

COMBINATION BAIL AND TIP FOR A SKI POLE

BACKGROUND OF THE INVENTION

The invention is directed to ski poles and particularly to the bales and tip end of the ski pole.

Ski poles are commonly used by a skier to aid skiing maneuvers in Alpine, in down hill, slalom, competition and cross-country activity and in cross-country skiing, for pleasure, competition, long-distance skiing and the like. The ski pole provides balance, facilitate turning and are used to propel the skier and even assist in braking the forward movement of the skier.

Generally the skier holds one pole in hand and each pole can comprise a shaft or shank which can be composed of metal or synthetic resin or either solid or the more preferable tube like form, and which is provided with a grip at its upper end and a point at its lower end.

The grip may be formed as a sleeve around the shaft and thus has a axis coincident with that of the shaft. A flexible or resilient open loop or closed loop or strap can be affixed to the head or distal end of the grip to be fitted over the wrist and thereby prevent loss of the poles by the skier.

Generally, the pointed end is adapted to bite into the snow or ice and project somewhat beyond a bale (basket) in the form of a disk or ring adjacent to or near the lower end of the pole to prevent excess penetration of the poles into the snow and to enable the pole to gain a more effective purchase of the snow.

The grip can be molded from any suitable resilient material such as plastic, rubber or the like.

Improved skills of the skiers have required more sophisticated skiing equipment and particularly poles which allow the skier better balance and a greater ability to maneuver and stop.

The loop or strap is always a problem in that in falls or the like the poles remains attached to the arm of the user via the loops or straps. This can be a dangerous condition as the poles can cause injury the user, for example, cause an arm to be broken or tip penetration into the body of the skier.

In some circumstances, the bale (also sometimes referred to as a basket or disk) can be come detached and lost thereby rendering the pole less useful as to limiting snow depth penetration of the pole.

Applicant's invention covered in application Ser. No. 07/913,881 filed on Jul. 16, 1992 and now U.S. Pat. No. 5,236,223, teaches a new and unique ski pole bale and tip which is quite successful in spring or summer skiing where the snow surface is soft and penetratable. It was found, however, that in icy conditions the tip did not sufficiently penetrate frozen snow or ice in the manner desired. This invention solves this deficiency of pole tip penetration in frozen snow and ice.

There has not been a completely successful way to overcome these last mentioned problems until the emergence of the instant invention.

SUMMARY OF THE INVENTION

The combination bail and tip of the present invention is formed separately from the pole and is fixedly secured to the tip of a conventional ski pole or the ski pole of the above noted patent application. The general purpose of the combination bail and tip of the present invention is to provide a tip which will penetrate snow regardless of the condition of the snow surface or under surface with the bail determining the depth to which the tip will penetrate. The combination bail and tip is formed from a either plastic, metal or the like suitable for the purpose intended. The outer surface is rectilinear and is formed at a right angle with the upper portion, when installed on a ski pole, the upper surface is normal to the longitudinal center line of the pole and the other leg of the right angle is parallel to the longitudinal center line of the pole.

The upper surface of the combination bail and tip includes an aperture for receiving the distal end of a ski pole which is fixedly secured therein by swedging, welding, soldering, adhesively bonding or the like suitable for the purpose intended. The other leg of the combination bale and tip is formed as a right angle wedge with a knife edge at the distal end thereof for penetrating the frozen surface of snow or ice.

The inner surface from the wedge to the outer surface of the upper surface of the combination bale and tip is substantially curvilinear from the wedge portion except for the area near the distal end of the upper surface which is rectilinear.

The upper surface widens out toward the distal end and terminates at a curvilinear outer surface.

An object of the is invention is to provide a combination bail and tip for a ski pole that will readily penetrate ice or frozen snow in normal use to a depth determined by the bail.

Another object of this invention is to provide a combination bail and tip for a ski pole that while penetrating ice or frozen snow is resistive to excessive penetration in ice or frozen snow.

Still another object of this invention is to provide a combination bail and tip for installation on a conventional ski pole distal end.

Other objects and features of the invention will become apparent as the drawings which follow are understood by reading the corresponding description thereof.

The subject mater which is regarded as this invention is particularly pointed out and distinctly claimed in the concluding portion of the specifications. The invention, however, as to its organization and operation, together with further objects and advantages thereof, will best be understood by reference to the accompanying drawings in which:

BRIEF DESCRIPTION OF THE DRAWING FIGURES

DETAILED DESCRIPTION OF THE PREFERRED EMBODIMENT

Figure 1:
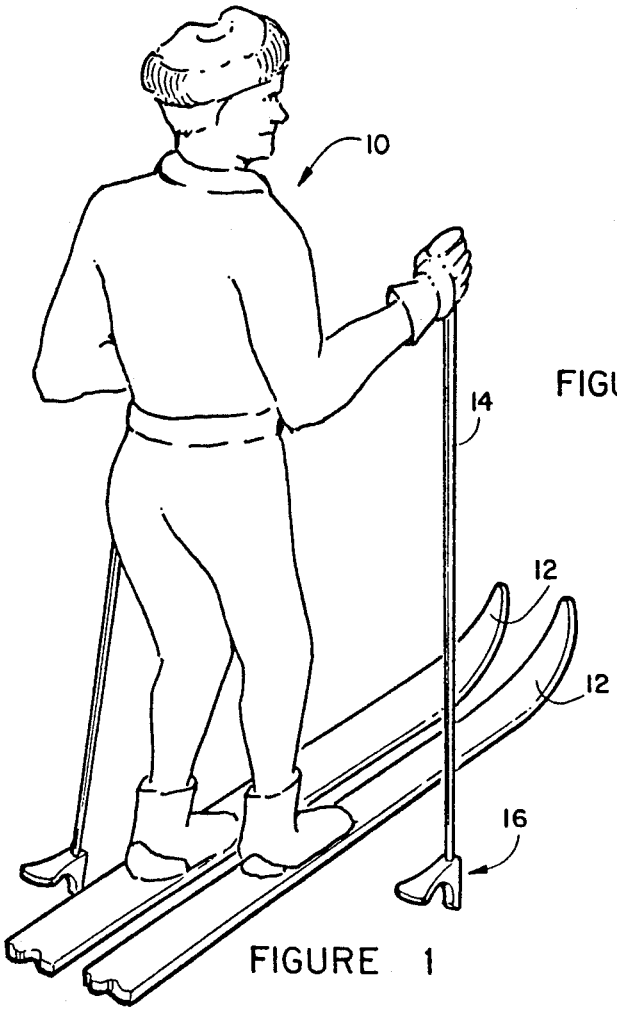
FIG. 1 depicts a skier using a ski pole utilizing the combination bail and tip of the present invention.

Referring now to the various drawing Figures, FIG. 1 depicts a skier 10 on skis 12 utilizing ski poles 14 with the combination bail and tip 16 of the invention.

Figure 2:
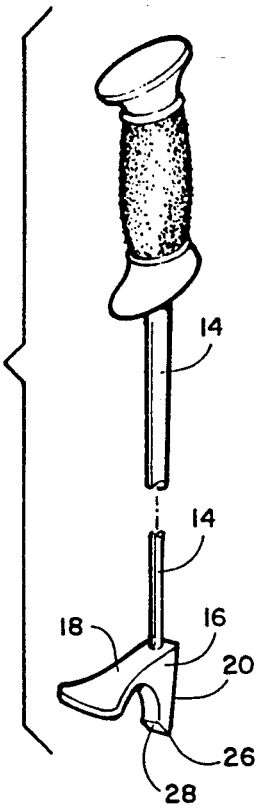
FIG. 2 is a detailed cutaway showing of the pole of FIG. 1 with the combination bail and tip of the invention.
Figure 3:
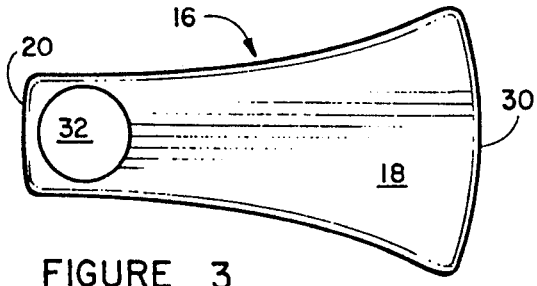
FIG. 3 is a top plan view showing of the ski pole combination bail and tip of the invention.
Figure 4:
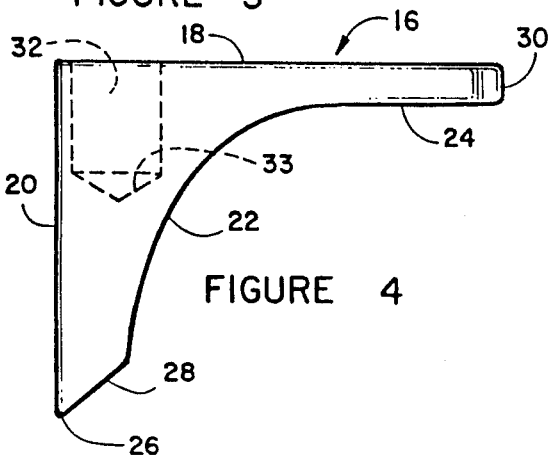
FIG. 4 is a showing depicting side view of the ski pole combination bail and tip of the invention.
Figure 5:
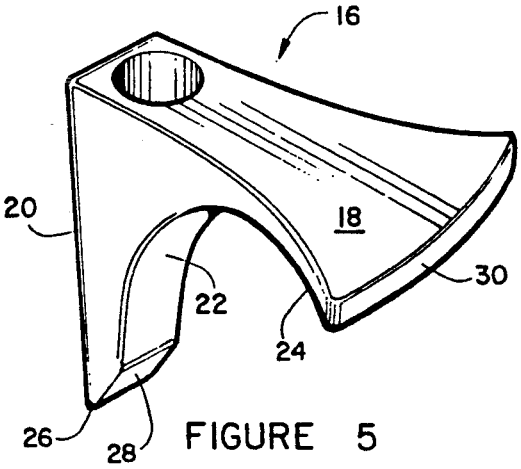
FIG. 5 is a showing depicting a perspective view of the ski pole combination bail and tip if the present invention.

FIG. 2 depicts an enlarged showing of the ski pole 14 and the combination bail and tip 16.

Referring now specifically to drawing FIGS. 2–5 which depict the combination bail and tip of the invention specifically. The combination bail and tip 16 includes outer rectilinear surfaces 18 and 20 and inner curvilinear surface 22 and rectilinear surface 24.

The distal end 26 of rectilinear surface 20 is in the form of a knife edge with the inner surface 28 thereof angled toward curvilinear surface 22. The distal end 26 is formed to penetrate ice or frozen snow when forced downward therein while the upper surface 18 limits depth of penetration of the distal end 26.

The outer rectilinear surface 18 spreads in width toward its distal end 30 in a smooth curvilinear manner. The distal end 30 is formed with a curvilinear outer surface. The increased width to the outer rectilinear surface 18 provides a large foot print or surface area to aid in preventing excessive penetration of the ski pole into the ice or frozen snow after penetration by distal end 26. The increased surface area of the outer rectilinear surface 18 resembles the bill of a duck bill platypus.

The outer rectilinear surface 18 includes a cylindrical opening 32 with a bottom surface 33 for receiving the distal end of the ski pole 14 therein. The pole can be swedged, welded, soldered, adhesively bonded or attached by any other suitable means to the bail or tip 16 via the walls of opening 32.

The combination ski pole bail and tip of the present invention can be employed on any type ski pole as a replacement of the conventional bail and tip by removing the end portion of a conventional ski pole or the tip and folded back area of the pole described in the United States Patent application mentioned above and installing the bail or tip 16 of the present invention in place thereof.

While described above are the principles of the embodiment of the ski pole combination bail and tip of the invention in connection with specific apparatus it is to be clearly understood that this description is made only by way of example and not as a limitation to the scope of the invention as set forth in the summary thereof and in the accompanying claims.

What is claimed is:

1. An improved combination bail and tip for a ski pole having a distal end comprising:

a first rectilinear surface having a distal end and an aperture for receiving the distal end of a ski pole therein, and first surface being normal to said aperture for receiving said pole therein;

a second rectilinear surface normal to said first rectilinear surface opposite to said distal end of said first rectilinear surface, said second rectilinear surface having a distal end with a knife edge at said distal end of said second rectilinear surface; and an inner surface extending from said knife edge to the distal end of said first rectilinear surface formed firstly in a rectilinear form, secondly in a curvilinear form and lastly in a rectilinear form.

2. The invention as defined in claim 1 wherein said first surface expands in width toward said distal end thereof.

3. The invention as defined in claim 1 wherein the distal end of said first surface is curvilinear.

4. The invention as defined in claim 2 wherein the distal end of said first surface is curvilinear.

5. The invention as defined in claim 1 wherein the distal end of said second surface is in the form of a right triangle.

6. The invention as defined in claim 1 wherein said aperture is a cylindrical opening through said first rectilinear surface having a bottom surface.

7. An improved ski pole having a distal end comprising:

a handle at one end thereof; a combination bail and tip at the other end thereof, said combination bail and tip comprising, a first rectilinear surface with a distal end and an aperture for receiving the distal end of a ski pole therein, said first surface being normal to said aperture for receiving said pole therein;

a second rectilinear surface normal to said first rectilinear surface with a distal end and a knife edge at said distal end; and an inner surface extending from said knife edge to the distal end of said first rectilinear surface being firstly in a rectilinear form, secondly in a curvilinear form and lastly in a rectilinear form.

8. The invention as defined in claim 7 wherein said first surface expands in width toward said distal end thereof.

9. The invention as defined in claim 7 wherein the distal end of said first surface is curvilinear.

10. The invention as defined in claim 8 wherein the distal end of said first surface is curvilinear.

11. The invention as defined in claim 7 wherein the distal end of said second surface is in the form of a wedge having a knife edge.

12. The invention as defined in claim 7 wherein said aperture is a cylindrical opening through said first rectilinear surface having a bottom surface.

* * * * *